US007322268B1

(12) United States Patent
Wallin

(10) Patent No.: US 7,322,268 B1
(45) Date of Patent: Jan. 29, 2008

(54) SHORT RANGE, NON-EXPLOSIVE, AIR DEFENSE SYSTEM FOR URBAN STRUCTURES

(75) Inventor: C. Roger Wallin, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 545 days.

(21) Appl. No.: 10/963,010

(22) Filed: Oct. 7, 2004

(51) Int. Cl.
*F41H 5/007* (2006.01)

(52) U.S. Cl. ..... 89/36.17; 89/1.11

(58) Field of Classification Search ..... 89/36.17, 89/1.11
See application file for complete search history.

(56) References Cited

U.S. PATENT DOCUMENTS 3,520,477 A * 7/1970 Cooley ..... 239/101
5,136,920 A 8/1992 Breed et al.
5,400,688 A * 3/1995 Eninger et al. ..... 89/1.11
6,805,035 B2 * 10/2004 Edberg et al. ..... 89/36.17
6,896,204 B1 * 5/2005 Greene et al. ..... 239/309

* cited by examiner

*Primary Examiner*—Stephen M Johnson
(74) *Attorney, Agent, or Firm*—James M. Kasischke; Michael P. Stanley; Jean-Paul A. Nasser

(57) ABSTRACT

A defense system for protecting a static structure, such as a building in an urban environment, from attack from an aircraft is provided. The air defense system includes at least one launching device for discharging a fluid payload at an incoming aircraft. Each launching device is mounted to an exterior wall of the static structure. In a preferred embodiment, the launching device is a water cannon. In a typical system, an array of launching devices are mounted to an exterior wall of the static structure which may be subject to attack from an aircraft.

15 Claims, 4 Drawing Sheets

SHORT RANGE, NON-EXPLOSIVE, AIR DEFENSE SYSTEM FOR URBAN STRUCTURES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to an air defense system for a static structure such as a building in an urban environment.

(2) Description of the Prior Art

The tragic events of Sep. 11, 2001, when commercial aircraft were used to accomplish suicide attacks on office buildings, have emphasized the need to be able to provide some means of air defense to civilian structures in an urban environment. Such structures may again be targeted by terrorist agents using aircraft to deliver an explosive payload, in a suicide dive, or in a manner similar to that of a car bomb attack. Any aircraft, large or small, that approaches a building at very close range may be a threat. Therefore, there is need to develop concepts for defending urban structures from close encounters with airborne vehicles.

A traditional air defense system, such as is used by military forces, typically involves firing an explosive device (missile or projectile) at a threatening aircraft. It is conceivable that such a system could be mounted on an office building to provide an air defense capability. The obvious disadvantage of such a system is that its use would impose an additional lethal threat to the area, in that bullets or other elements of explosive ammunition would rain down upon nearby streets and could adversely impact civilian occupied structures other than the one that was being defended.

One type of missile defense system known in the prior art is shown in U.S. Pat. No. 5,400,688 to Eninger et al. This missile defense system generates a change in density in the air path of a missile. The density change is created by a high pressure water system which can be generated by a water jet or a body of water explosively created from a water surface. The change in density creates an effective barrier against an incoming missile.

It is also known in the prior art that water cannons may be used to neutralize a bomb. One such system for doing this is shown in U.S. Pat. No. 5,136,920 to Breed et al.

In an urban setting, a preferred defensive capability would be one in which something could be fired at close range against an incoming aircraft to deter its attack, but the spent ammunition would become harmless beyond a calculated short distance from the defended structure.

Further, a traditional air defense gun or missile launcher uses explosive chemicals to discharge or launch the weapon's payload. The presence of such material in an urban environment, such as an office building, is likely to be unacceptable. Therefore, a preferred defensive system would also be one that does not require explosive devices of any kind, either for launch or damage to the target.

As can be seen from the foregoing discussion, there is a need for an air defense system which avoids the difficulties associate with conventional air defense systems and which is viable for use in an urban environment.

SUMMARY OF THE INVENTION

Accordingly, it is an object of the present invention to provide an air defense system for a static structure.

It is a further object of the present invention to provide an air defense system which can be fired at close range against an incoming aircraft to deter its attack and which uses ammunition which becomes harmless after a short distance.

It is a further object of the present invention to provide an air defense system which does not require explosive devices of any kind.

The foregoing objects are attained by the air defense system of the present invention.

In accordance with the present invention, an air defense system for protecting a static structure is provided. The air defense system broadly comprises at least one launching device for discharging a fluid payload for contacting an incoming aircraft and each launching device being mounted to an exterior surface of the static structure. In a preferred embodiment of an air defense system, each launching device comprises a water cannon mounted to an exterior wall of a building.

Other details of the air defense system of the present invention, as well as other objects and advantages attendant thereto, are set forth in the following detailed description and the accompanying drawings wherein like reference numerals depict like elements:

DESCRIPTION OF THE PREFERRED EMBODIMENT(S)

The present invention is directed to an air defense system which can be mounted to static structures, such as buildings. The air defense system has a simple launching device which is configured to discharge a cylindrical containment of fluid in a preferred direction. The launching device may be considered a "water cannon" that expels a package of fluid when a force is applied at the end of its longitudinal axis. The slug of water is effective as a battering ram to damage objects at close range to the cannon.

Figure 1:
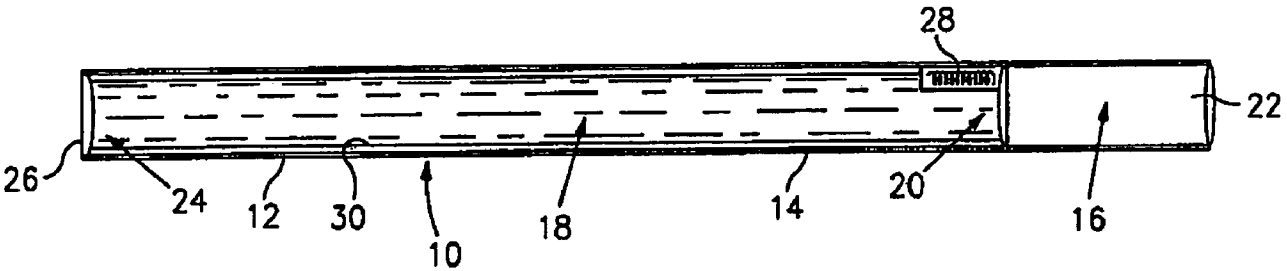
FIG. 1 is a schematic representation of a cannon to be used in the air defense system of the present invention.

FIG. 1 is a diagram of a launching device or water cannon 10 that can be employed in the air defense system of the present invention and that can accomplish the goal of this invention. The barrel 12 of the launching device 10 may be a stiff tube that can be mounted on the exterior of a building or other static structure to be protected. The barrel 12 is divided into two chambers 14 and 16. The chamber 14 is larger than chamber 16 and contains the fluid payload 18. The chamber 16 contains the source of energy that ejects the liquid slug or ram from the barrel 12. A frangible separator or diaphragm 20 prevents the fluid from entering the energy chamber 16. The energy chamber 16 may contain a pressurized flask 22 of inert gas which is designed and configured to be released in the direction of the fluid payload 18, thereby expelling the fluid payload 18 from the barrel 12 at high pressure. An example of such a flask is a commercial inflator commonly used by the automotive industry to energize safety air bags. The flask 22 may also be any type of compressed gas canister that can be actuated by application of a simple electric impulse signal. The gas in the flask 22 may be released when an electrical signal is applied to it.

The fluid payload 18 in the barrel 12 is sealed until fired by a frangible cap 24 at the outer or muzzle end 26. The fluid payload 18 is preferably a benign, biodegradable substance that will not endanger personnel or the environment due to its chemical composition. Pure water is a most preferred choice. However, the fluid payload 18 may be a more dense fluid, achieved by a suitable solution.

If desired, a heater 28, such as an electrical wire heater, may be embedded in the barrel 12 in order to maintain the fluid payload 18 as a liquid in a cold ambient condition such as one below freezing temperatures.

In order to concentrate the fluid payload 18 in the form of a slug when it is launched, a lightweight, thin, flexible sleeve 30, or "sabot", may line the interior of the chamber 14 so as to provide an envelope of containment. The use of the sleeve 30 should prevent the fluid payload 18 from immediate dispersal in the air when first ejected from the barrel 12. The sleeve 30 will be fractured during discharge, such that the fluid within it will eventually disperse, but only after traveling the distance needed to be effective as a battering ram against an aircraft at a very close range.

Figure 2:
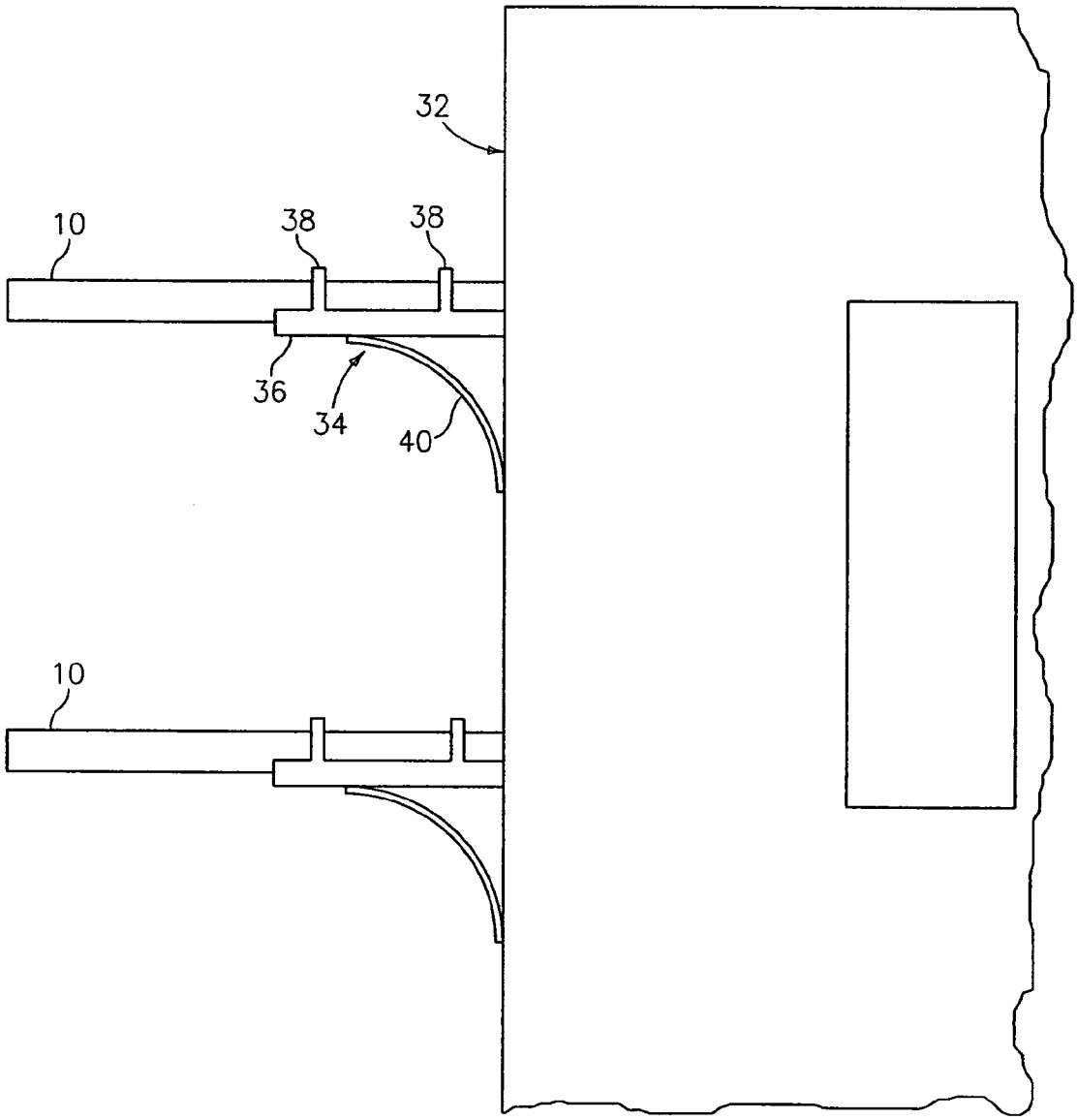
FIG. 2 is a schematic representation of an array of cannons attached to the side of a building.

FIG. 2 illustrates one system 34 for mounting a launching device 10 to an exterior wall 32 of a building to be defended. As can be seen from this figure, a plurality of launching devices 10 may be mounted to the wall 32. The mounting system 34 may comprise a mounting saddle 36 shaped to receive the barrel 12 and a pair of straps 38 connected to the saddle 36 and surrounding the barrel 12. The mounting system 34 further comprises a bracket 40 which may be secured to the wall 32 and the saddle 36 using any suitable means known in the art.

Figure 3:
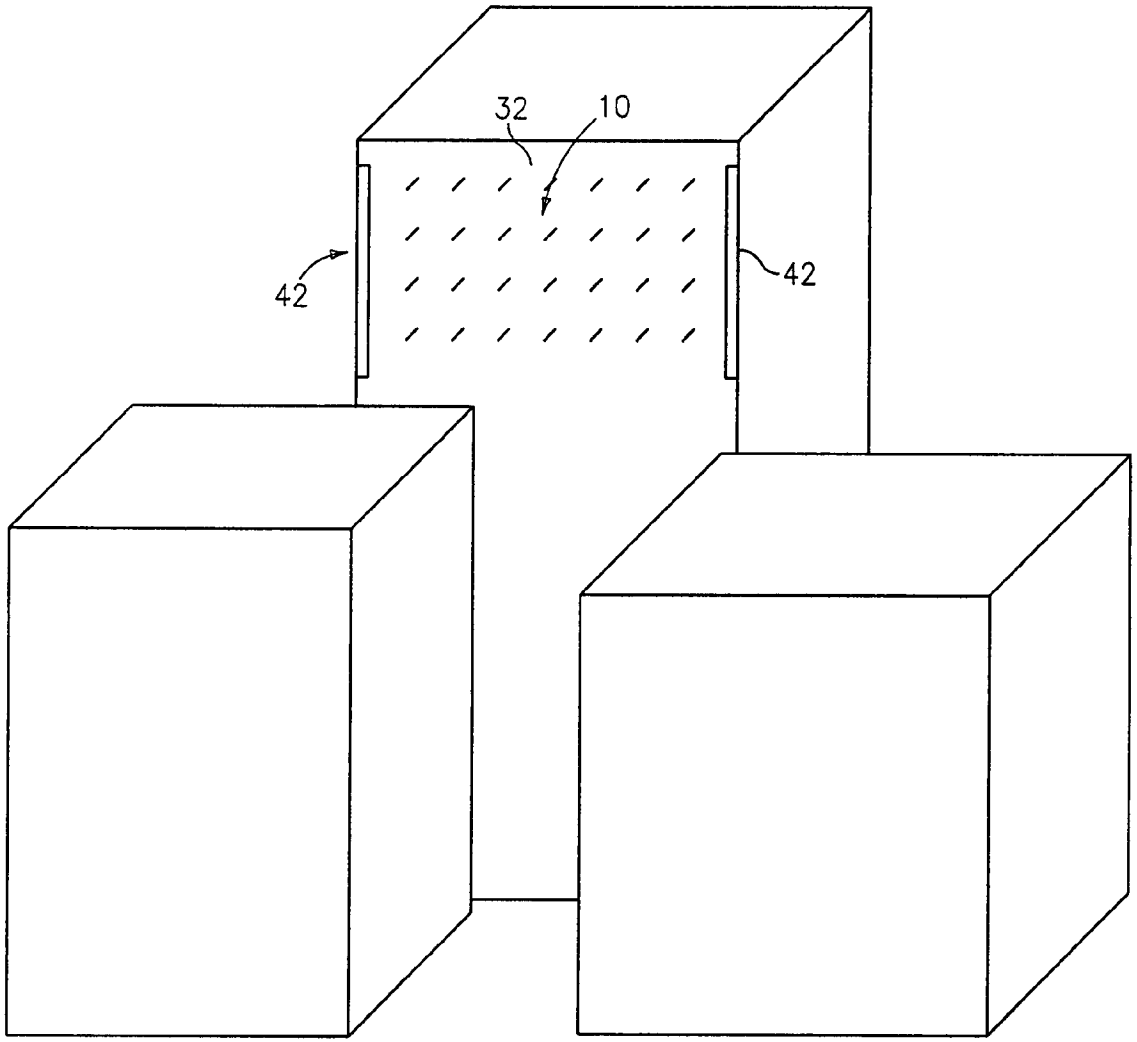
FIG. 3 is a schematic representation of a building having the air defense system of the present invention.

FIG. 3 illustrates an array of launching devices 10 mounted on a wall 32 of a static structure. The array of launching devices may be in sufficient number and spacing to perform the protection function. While the figure depicts the launching devices 10 as being mounted to one wall of the static structure, arrays of launching devices 10 can be mounted to each exterior wall of the static structure which is vulnerable to the approach of an aircraft. As shown in FIG. 3, a plurality of aircraft detection sensors 42 may be mounted to the exterior wall 32 such as at the corners of the wall 32. The sensors 42 may comprise any suitable sensors known in the art such as radar sensors tuned to detect objects at short ranges. Alternatively, the sensors 42 may be laser range finding sensors.

Figure 4:
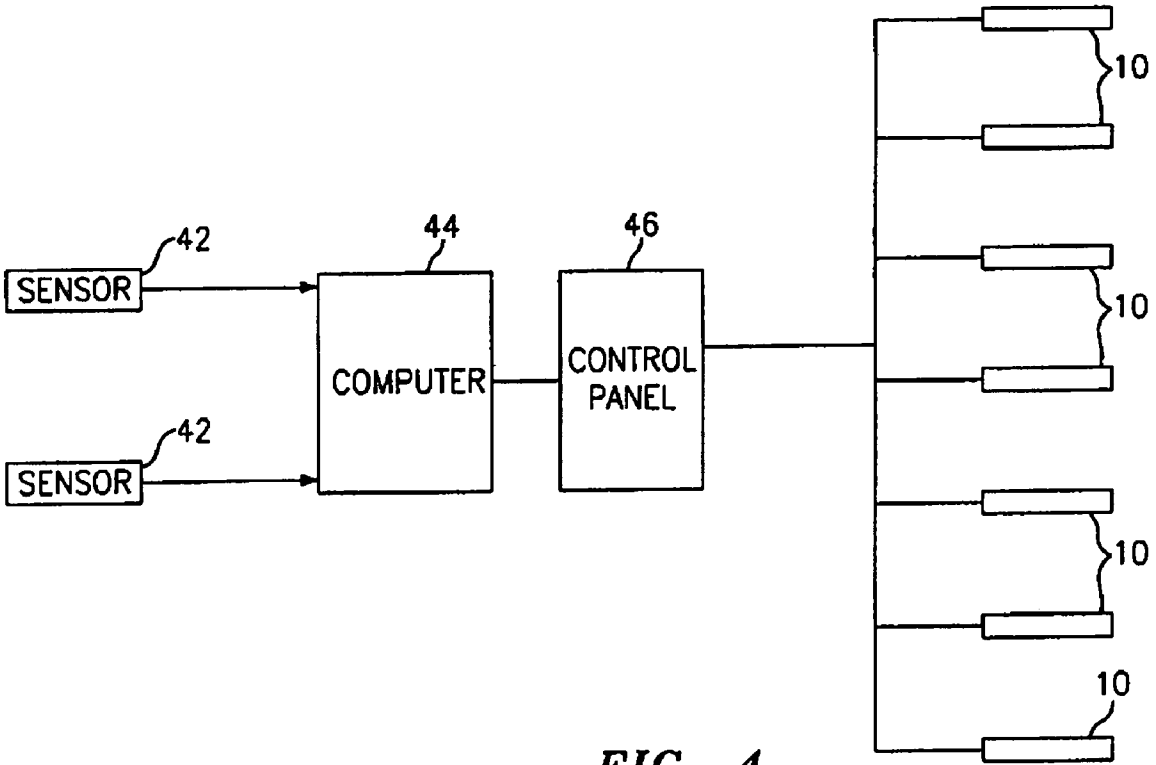
FIG. 4 is a schematic representation of a threat detecting system used in the air defense system of the present invention.

The function of the sensors 42 is to determine the presence or approach of an aircraft, and to sense changes in its position (range rate). As shown in FIG. 4, the sensors 42 provide an input to a computer 44 which determines whether the aircraft is at, or is approaching, a predetermined threshold range, close to the building. When that threshold is reached, the computer 44 orders the array of launching devices 10 to be discharged. This is accomplished automatically by transmission of electric firing signals from a control panel 46 through wiring to the gas flasks 22 in the launching devices 10 of the array.

Figure 5:
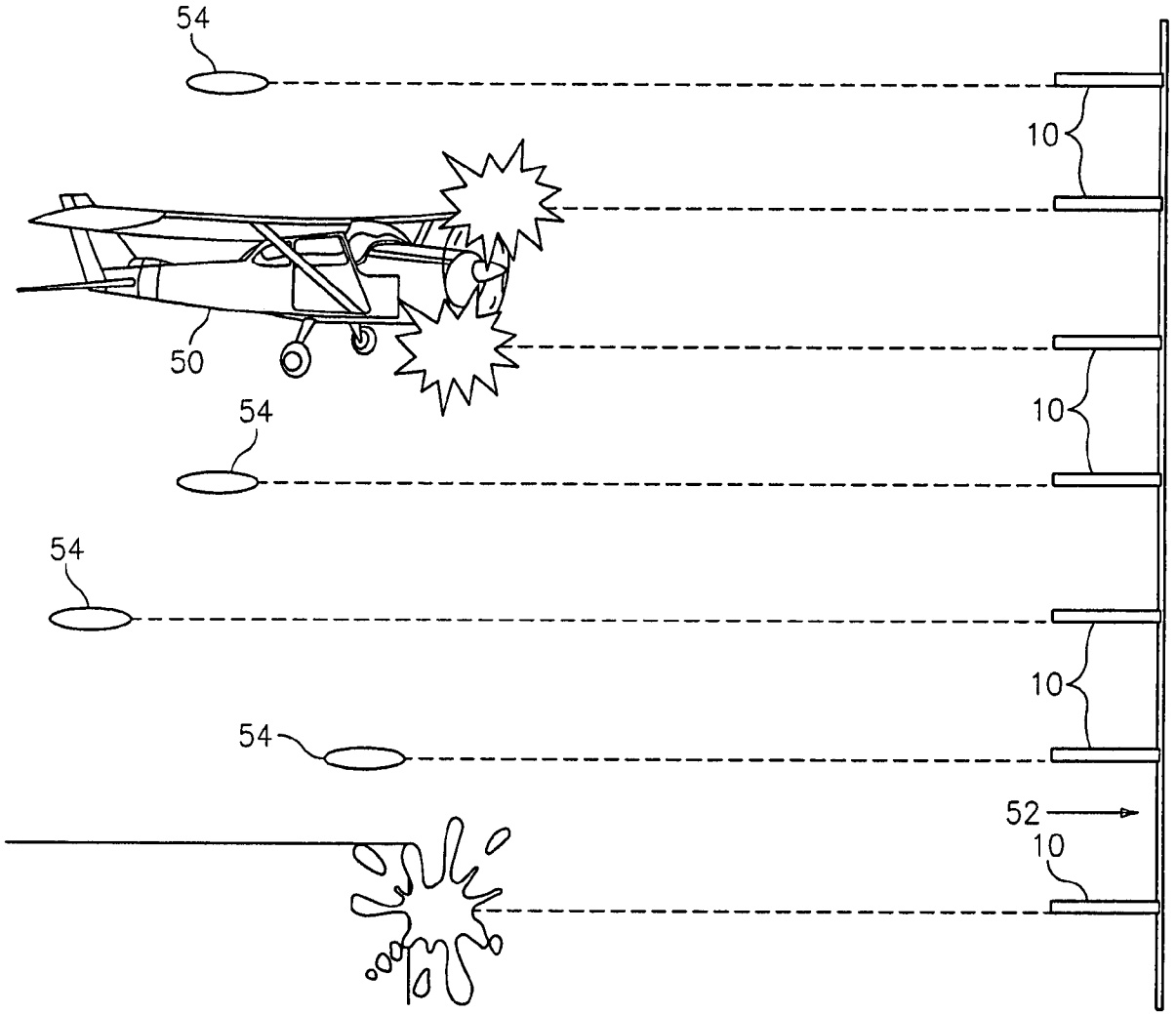
FIG. 5 is schematic representation of an active air defense system in accordance with the present invention.

FIG. 5 illustrates the operational concept of the present invention. When an aircraft 50 is sensed at dangerously close range to the defended building 52, the array of launching devices 10 will be discharged automatically. The result is a mass of fluid modules 54 that will be present in the air between the aircraft 50 and the building 52. The slugs of fluid have sufficient momentum to break up or divert a light aircraft or helicopter. With respect to large aircraft, the slugs of fluid would reduce the kinetic energy of a collision with the building, and thus mitigate damage to the building. Those fluid slugs that do not strike the aircraft should break up and fall as drops of liquid, thereby being of no danger to objects or persons below.

The air defense system of the present invention provides a measure of air defense capability to civilian structures such as office buildings where none has previously existed.

The air defense system of the present invention does not use or depend upon any explosive ammunition, propellants, or other potentially dangerous ordnance. Therefore, it is uniquely suited to a civilian defense application. Military equipment used to defend an urban environment would require special handling and personnel.

The effective range of the system is intended to be very short, and it is designed to lose its damaging force when that range has been exceeded, thereby rendering it safe to objects other than the intended target.

The system is designed with no moving parts. Further, the launching devices are intended to be sealed canisters that do not require scheduled maintenance. Once installed and energized, the air defense system remains ready, in a manner similar to a fire extinguishing system, which is continually available.

The present invention is intended to reduce the potential damage that will result in the event of an aircraft being flown into a static structure. The air defense system has significant value as a deterrent to that type of irrational air attack. The appearance of a building configured with an array of launching devices on its exterior walls signals that there is an obvious measure of defensive capability present. The extent and quality of that capability will be unknown to an enemy unless the enemy elects to challenge the system.

If desired, the launching devices 10 may be provided with the capacity to be reloaded and re-charged with gas flasks without removing the equipment from the side of the defended structure. To this end, each of the chambers 14 and 16 may be provided with suitable access openings.

The launching devices 10 in an array mounted to an exterior wall of a static structure may be fired simultaneously or by delayed sequence to achieve optimum effectiveness.

It is apparent that there has been provided in accordance with the present invention a short range, non-explosive, air defense system for urban structures which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. An air defense system for a static structure comprising:

at least one launching device for discharging a fluid payload for contacting an incoming aircraft;

means within each said launching device for concentrating said fluid payload in slug form; and each said launching device being mounted to an exterior surface of said static structure.

2. An air defense system according to claim 1, wherein each said launching device comprises a tube having first and second chambers.

3. An air defense system according to claim 2, further comprising a source of energy in a first one of said chambers.

4. An air defense system according to claim 3, further comprising said fluid payload being positioned within a second one of said chambers and said first and second chambers being separated by a frangible separator.

5. An air defense system according to claim 3, wherein said source of energy comprises a flask containing a pressurized fluid and means for actuating said flask to discharge said pressurized fluid.

6. An air defense system according to claim 2, further comprising a frangible cap over an end of said tube to seal said tube and to maintain said fluid payload within said tube.

7. An air defense system according to claim 1, wherein said fluid payload comprises a benign, biodegradable substance.

8. An air defense system according to claim 1, further comprising means for maintaining the fluid payload in a fluid condition at temperatures below freezing.

9. An air defense system according to claim 1, wherein said concentrating means comprises a sleeve about said fluid payload.

10. An air defense system according to claim 1, further comprising a saddle and bracket for mounting each said launching device to an exterior wall of said static structure.

11. An air defense system according to claim 1, wherein said static structure comprises a building and each said launching device is mounted to an exterior wall of said building.

12. An air defense system according to claim 1, further comprising means for detecting a threat and for sending a signal to each said launching device to launch said fluid payload.

13. An air defense system according to claim 12, wherein said threat detecting and signal sending means comprises at least one threat sensor mounted to an exterior wall of said static structure and for transmitting a signal to a computer and said computer sending a firing signal to each said launching device if a threshold has been exceeded.

14. An air defense system comprising an array of launching devices, each said launching device comprising:

a tube having a first chamber and a second chamber;

a frangible diaphragm within said tube separating said first chamber and said second chamber;

a fluid payload in said first chamber for discharge; and a flask containing a pressurized gas positioned in said second chamber.

15. An air defense system according to claim 14, further comprising means for detecting a threat and for sending a signal to said flask in each said launching device to discharge the pressurized gas and to cause the fluid payload to be discharged.

* * * * *